US009212341B2

(12) United States Patent
Bigorra Llosas et al.

(10) Patent No.: US 9,212,341 B2
(45) Date of Patent: Dec. 15, 2015

(54) COMPOSITIONS FOR DEGREASING HARD SURFACES

(71) Applicant: Institut Univ. De Ciéncia I Tecnologia, S.A., Mollet del Vallés (ES)

(72) Inventors: Joaquin Bigorra Llosas, Sabadell (ES); Javier Raya, Sant Joan Despi (ES); Ramon Valls, Barcelona (ES); Carles Estevez, Sitges (ES); Lidia Galiéa, Girona (ES); Josep Castells, Montmeló (ES)

(73) Assignee: Institut Univ. de Ciencia i Tecnologia, s.a., Barcelona (ES)

( * ) Notice: Subject to any disclaimer, the term of this patent is extended or adjusted under 35 U.S.C. 154(b) by 124 days.

(21) Appl. No.: 14/246,736

(22) Filed: Apr. 7, 2014

(65) Prior Publication Data

US 2014/0256609 A1 Sep. 11, 2014

Related U.S. Application Data

(62) Division of application No. 12/988,414, filed as application No. PCT/EP2009/002667 on Apr. 9, 2009, now abandoned.

(30) Foreign Application Priority Data

Apr. 19, 2008 (EP) ..... 08007673

(51) Int. Cl.

| | |
|---|---|
| ***C11D 1/72*** | (2006.01) |
| ***C11D 7/50*** | (2006.01) |
| ***C11D 1/52*** | (2006.01) |
| ***C11D 11/00*** | (2006.01) |
| ***C23G 5/028*** | (2006.01) |
| ***C23G 5/036*** | (2006.01) |

(52) U.S. Cl.

CPC ..... *C11D 7/5013* (2013.01); *C11D 1/521* (2013.01); *C11D 11/0029* (2013.01); *C23G 5/02883* (2013.01); *C23G 5/036* (2013.01)

(58) Field of Classification Search

CPC ..... C11D 7/50; C11D 7/5013; C11D 11/0029
See application file for complete search history.

(56) References Cited

U.S. PATENT DOCUMENTS

| | | | | |
|---|---|---|---|---|
| 3,072,460 | A | 1/1963 | Young | |
| 3,554,917 | A | 1/1971 | Buckman et al. | |
| 4,132,657 | A * | 1/1979 | Verdicchio | B01F 17/0064 508/389 |
| 4,282,147 | A | 8/1981 | Dieterich | |
| 4,609,488 | A | 9/1986 | Geke et al. | |
| 5,817,736 | A | 10/1998 | von Gentzkow et al. | |
| 6,095,161 | A | 8/2000 | Vaartstra | |
| 7,988,827 | B2 | 8/2011 | Valls et al. | |
| 2001/0023298 | A1 | 9/2001 | Weinelt | |
| 2008/0185113 | A1 | 8/2008 | Valls et al. | |
| 2008/0188688 | A1 | 8/2008 | Huesken et al. | |
| 2009/0062565 | A1 | 3/2009 | Bigorra Llosas et al. | |
| 2010/0113279 | A1 * | 5/2010 | Mas | A01N 25/02 504/362 |
| 2010/0323891 | A1 | 12/2010 | Llosas et al. | |
| 2010/0323898 | A1 | 12/2010 | Bigorra Llosas et al. | |

FOREIGN PATENT DOCUMENTS

| | | | | |
|---|---|---|---|---|
| DE | 19747891 | | 5/1999 | |
| DE | 19747891 | A1 * | 5/1999 | B08B 7/0014 |
| EP | 0242918 | | 10/1987 | |
| GB | 1092798 | | 11/1967 | |
| GB | 2352730 | | 2/2001 | |
| GB | 2405639 | | 9/2005 | |
| WO | WO-99/20408 | | 4/1999 | |
| WO | WO-00/66697 | | 11/2000 | |
| WO | WO-02/055640 | | 7/2002 | |

OTHER PUBLICATIONS

Final Office Action in U.S. Appl. No. 12/988,414, dated Oct. 18, 2013, 7 pages.
Non-Final Office Action in U.S. Appl. No. 12/988,414, dated May 10, 2013, 6 pages.

* cited by examiner

*Primary Examiner* — Gregory Webb
(74) *Attorney, Agent, or Firm* — Servilla Whitney LLC

(57) ABSTRACT

Suggested are degreasing compositions comprising at least one dialkyl amide according to general formula (1) $R^1CO—NR^2R^3$ (I) in which $R^1CO$ stands for a linear or branched, saturated or unsaturated, aliphatic or aromatic, optionally hydroxysubstituted acyl radical having 2 to 56 carbon atoms, and $R^2$ and $R^3$ represent independently from each other alkyl radicals having 1 to 6 carbon atoms.

9 Claims, No Drawings

COMPOSITIONS FOR DEGREASING HARD SURFACES

CROSS-REFERENCE TO RELATED APPLICATIONS

This application is a divisional of U.S. Ser. No. 12/988,414, filed on Oct. 18, 2010, which is the National Stage entry of PCT/EP2009/002667, filed on Apr. 9, 2009, which claims priority to European Patent application number 08007673, filed on Apr. 19, 2008, the disclosures of which are incorporated herein by reference in their entireties.

TECHNICAL FIELD

The present invention is related to the area of metal treatment and refers to new degreasing compositions, a process for degreasing hard surfaces and the use of green solvents for degreasing operations.

BACKGROUND

In ordinary metal processing metal parts are greased to avoid the corrosion process during their manufacture, storage and transport. Since the degreasing agent is incompatible with subsequent metal processing stages, a cleaning step to remove the metal protector is inevitable. Over the past few years, one of the major challenges in the area of metal degreasing has been the transition from fully emissive open-top systems based on the use of chlorinated solvents to closed-loop metal-degreasing systems based on low VOC emission, low toxicity solvents. Alternative chlorinated solvents such as trichloroethanol, chloroform, methyl chloride, CFC-113, HFCs, HCFCs, $CO_2$ jets, $scCO_2$, semi-aqueous solvents, alkaline cleaning agents, emulsifying detergent-based cleaners, and aliphatic hydrocarbon based solvents and azeotropic mixtures have been proposed to replace the widely used current industrial standard, namely trichloroethylene. However, none of the proposed alternatives fully satisfy the key industrial needs of the metal finishing sector.

Therefore the object of the present invention has been to develop new compositions allowing to perform metal degreasing operations in highly variable settings, with metal parts of different size and shape, minimizing diffuse emission, release of contaminated air during loading and unloading, and solvent release from cleaned metal parts. The use of these compositions should also avoid the generation of large waste streams, allowing to establish an easy and cost effective process in order to recycle solvent and rinsing water and ultimately delivering parts adequately conditioned for immediate use in subsequent steps of the metal finishing process. More particularly the present invention intends to replace commercial degreasing solvents known from the market by new compositions being more efficient, safer and friendlier to the environment.

DETAILED DESCRIPTION

The present invention refers to new degreasing compositions comprising at least one dialkyl amide according to general formula (I)

$$R^1CO—NR^2R^3 \quad (I)$$

in which $R^1CO$ stands for a linear or branched, saturated or unsaturated, aliphatic or aromatic, optionally hydroxysubstituted acyl radical having 2 to 56 carbon atoms, and $R^2$ and $R^3$ represent independently from each other alkyl radicals having 1 to 6 carbon atoms. Preferred solvents are mixtures of dialkylamides according to general formula (I) in which $R^1CO$ stands for alkyl radicals having 6 to 10 carbon atoms and $R^2$ and $R^3$ represent methyl radicals.

Surprisingly it has been observed that dialkyl amides, regardless whether the metal surfaces have been protected by solvent based or cereous metal preservatives containing antioxidants and other additives show a. high degreasing efficacy compared with improved ecotoxicological behaviour. In addition, the solvents can be easily rinsed off with water, collected and then recycled without any additional purification. Replacing well known chlorinated organic degreasing solvents (e.g. trichloroethanol trichloroethylene, perchloroethylene) by dialkyl amides leads to a more environmentally friendly process without losing performance.

Degreasing Process

Another object of the present invention relates to a a method for the degreasing of hard surfaces, characterised in that said surfaces are brought into contact with at least one organic solvent selected from the group consisting of dialkyl amides according to general formula (I), $$R^1CO—NR^2R^3 \quad (I)$$

in which $R^1CO$ stands for a linear or branched, saturated or unsaturated, aliphatic or aromatic, optionally hydroxysubstituted acyl radical having 4 to 56 carbon atoms, and $R^2$ and $R^3$ represent independently from each other alkyl radicals having 1 to 6 carbon atoms.

Dialkyl Amides

Dialkyl amides suitable as green solvent for conducting the degreasing process can be derived from linear or branched, saturated or unsaturated, aliphatic or aromatic, optionally hydroxysubstituted carboxylic acids having 2 to 56 carbon atoms, as for example caprylic acid, caprilic acid, capronic acid, Laurie acid, myristic acid, palmitic acid, palmoleic acid, stearic acid, isostearic acid, oleic acid, petroselinic acid, linolic acid, linoleic acid, ricinoleic acid, 12-hydroxystearic acid, arachidonic acid, gadoleic acid, erucic acid, behenic acid and their technical grade mixtures like coco fatty acid, tallow fatty acid and the like. Another group of carboxylic acid represent the so-called "dimeric acids", which are obtained by dimerisation or trimerisation of oleic acid. Preferred dialkyl amides are derived from saturated fatty acids having 6 to 10 carbon atoms or oleic acid. Also suitable are certain hydroxy carboxylic acids, like for example lactic acid or aromatic carboxylic acids like for example benzoic acid. The alkyl groups are derived from alcohols having 1 to 6 carbon atoms, therefore "alkyl" may stand for ethyl, propyl, butyl, pentyl or hexyl, however preferably for methyl groups. Consequently, the preferred dialkyl amides are dimethyl amides based on the preferred fatty acids cited above.

As explained above, typically the hard surfaces represent metal surfaces, such as those used in the manufacture of automotive and building components. The dialkyl amides, which are used as so-called "green solvents" serve as degreasing agents in order to remove all greases and stains, in particular the preservatives from the surfaces. This can be done either by tipping the parts into the solvent or—more convenient—by spraying. Once degreasing has taken place, the dialkyl amides are collected and recycled without purification.

Industrial Application

As outlined above, dialkyl amides show excellent performance in removing stains, grease and especially preservatives from hard surfaces. Another object of the present invention is therefore directed to the use of dialkyl amides according to general formula (I)

$$R^1CO—NR^2R^3 \quad (I)$$

in which $R^1CO$ stand for a linear or branched, saturated or unsaturated, aliphatic or aromatic, optionally hydroxysubstituted acyl radical having 4 to 56 carbon atoms, and $R^2$ and $R^3$ represent independently from each other hydrogen or alkyl radicals having 1 to 6 carbon atoms, as degreasing agents for hard surfaces.

EXAMPLES

Metal Degreasing Procedure

For our evaluation, a comparative method was used, in which removal efficacy (RE) of several alternative solvents are compared with RE value obtained for the industrial standard degreaser, trichloroethylene.

Removal Efficacy (RE) measures the degree of removal of organic materials (grease and/or solvent) from the surface of metal parts. Removal efficacy screening test, remove the grease of ten metallic greased pieces by degreasing process. The standard procedure was done by bringing the solvent into contact with the metal surface, more particular by inmersion without agitation during 10 minutes in one volume of fresh solvent followed by three consecutive washing cycles by inmersion in clean water. The amount of organic material (grease and/or solvent) that was not eliminated by the assayed procedure was determined by direct weight after removal of organic residues from the metallic parts by standard cleaning procedure with trichloroethylene.

The removal efficacy (RE) for a standard degreasing solvent in industry $CHCl{=}CO_2$ is between 94-98% depending on the nature of the preservative (Table 1). These RE values were used to compare with the results obtained by assayed solvents and to determine their effectiveness compared with trichloroethylene.

TABLE 1

Removal Efficacy (%) value for trichloroethylene

| Preservative | A (solvent-based) | B (cereous-based) |
|---|---|---|
| RE (%) | 94.2 | 98.1 |

Example 1

Degreasing Studies with Dimethylamide Solvents

The degreasing efficacy of the DMA solvent family was studied. These experiments remove the grease of ten greased pieces according to the procedure described before. This experiment was carried out for two different greases and the obtained results are described in table 2.

TABLE 2

RE (%) value normalized to trichloroethylene for dimethyl amide (DMA) solvents

| Solvent | Solvent-based preservative | Cereous preservative |
|---|---|---|
| Trichloroethylene | 100.0 | 100.0 |
| Capronic acid dimethylamide | 95.58 | 99.68 |

TABLE 2-continued

RE (%) value normalized to trichloroethylene for dimethyl amide (DMA) solvents

| Solvent | Solvent-based preservative | Cereous preservative |
|---|---|---|
| Caprylic acid dimethyl amide | 45.71 | 91.87 |
| Caprinic acid dimethyl amide | 23.03 | 86.66 |
| Benzoic acid dimethyl amide | 40.34 | 66.27 |
| Lactic acid diemthyl amide | — | 56.68 |
| Oleic acid dimethylamide | — | 65.23 |

Example 2

Recovery and Regeneration of Solvent

In order to have an economically viable process, the degreasing solvent must be able to be used several times without any prior purification. For this reason reusability of the solvent capronic acid dimethyl amide (DMA-6) has been studied in both preservatives. The results are outlined in Table 3.

TABLE 3

RE Reusability of DMA-6 (values normalized to trichloroethylene).

| Number of cycles | Solvent based preservative | Cereous preservative |
|---|---|---|
| 1 | 95.02 | 99.68 |
| 2 | 91.94 | 100.47 |
| 5 | 91.94 | 99.94 |
| 9 | — | 99.31 |
| 12 | — | 94.81 |

After 5 cycles with the solvent-based preservative the loss in efficiency was less than 4%. In the case of the cereous preservative, the solvent can be reused 12 times with a loss in efficiency of only 5%.

What is claimed is:

1. A method for degreasing a hard surface, comprising the step of contacting a hard surface with at least one organic solvent selected from the group consisting of dialkyl amides of general formula (1), $$R^1CO—NR^2R^3 \quad (I)$$

wherein $R^1CO$ represents a linear or branched, saturated or unsaturated, aliphatic or aromatic, optionally hydroxysubstituted acyl group having 2 to 56 carbon atoms, and $R^2$ and $R^3$ independently represent alkyl groups having 1 to 6 carbon atoms;

wherein the at least one dialkyl amide of formula (I) is present in the organic solvent in an amount effective to provide degreasing efficacy.

2. The method of claim 1, wherein said dialkyl amides are derived from saturated fatty acids having 6 to 10 carbon atoms.

3. The method of claim 1, wherein said dialkyl amides are derived from oleic acid.

4. The method of claim 1, wherein said dialkyl amides are derived from lactic acid.

5. The method of claim 1, wherein said dialkyl amides are derived from benzoic acid.

6. The method of claim 1, wherein that said hard surface comprises a metal surface.

7. The method of claim 1, further comprising the steps of collecting and recycling said organic solvent without purification, after degreasing has taken place.

8. A method of degreasing a hard surface, comprising the step of contacting a hard surface with a degreasing composition comprising at least one dialkyl amide of formula (I), $$R^1CO\text{-}NR^2R^3 \quad (I)$$

wherein $R^1CO$ represents a linear or branched, saturated or unsaturated, aliphatic or aromatic, optionally hydroxysubstituted acyl group having 2 to 56 carbon atoms, and $R^2$ and $R^3$ independently represent alkyl groups having 1 to 6 carbon atoms.

9. The method of claim 8, wherein said hard surface comprises a metal surface.

* * * * *